US006367436B2

(12) United States Patent
Pierik

(10) Patent No.: US 6,367,436 B2
(45) Date of Patent: Apr. 9, 2002

(54) BELT-DRIVEN VARIABLE VALVE ACTUATING MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/792,734

(22) Filed: Feb. 23, 2001

Related U.S. Application Data

(60) Provisional application No. 60/184,544, filed on Feb. 24, 2000.

(51) Int. Cl.[7] ..... F01L 13/00

(52) U.S. Cl. ..... 123/90.16; 123/90.17; 123/90.31; 74/568 R

(58) Field of Search ..... 123/90.15, 90.16, 123/90.17, 90.31, 90.22, 90.39, 90.6; 74/567, 568 R

(56) References Cited

U.S. PATENT DOCUMENTS

| | | | | | |
|---|---|---|---|---|---|
| 5,301,638 | A | * | 4/1994 | Eggers | 123/90.16 |
| 5,937,809 | A | * | 8/1999 | Pierik et al. | 123/90.16 |
| 6,019,076 | A | * | 2/2000 | Pierik et al. | 123/90.16 |
| 6,041,746 | A | * | 3/2000 | Takemura et al. | 123/90.16 |
| 6,123,053 | A | * | 9/2000 | Hara et al. | 123/90.16 |
| 6,311,659 | B1 | * | 11/2001 | Pierik | 123/90.24 |

OTHER PUBLICATIONS

Feb. 22, 2001, Hydraulic Actuator for Variable Valve Mechanism Attorney Docket No. 89190.155600/DP–301941, Ronald J. Pierik.

Feb. 22, 2001, Ring Gear Variable Valve Train Device Attorney Docket No. 89190.156000/DP–301944, Ronald J. Pierik.

Jan. 5, 2001, Cam Link Variable Valve Mechanism Attorney Docket No. 89190.155800/DP–302110, Ronald J. Pierik.

Jan. 5, 2001, Variable Valve Mechanism Having an Eccentric–Driven Frame Attorney Docket No. 89190.155500/DP–300877, Ronald J. Pierik.

Jan. 12, 2001, Actuator for Variable Valve Mechanism Attorney Docket No. 89190.155300/DP–204887, Ronald J. Pierik.

Jan. 19, 2001, Linkless Variable Valve Actuation Mechanism Attorney Docket No. 89190.155700/DP–204888, Ronald J. Pierik.

Feb. 23, 2001, Crank Gear Variable Valve Actuating Mechanism Attorney Docket No. 89190.026301/DP–301943, Ronald J. Pierik.

* cited by examiner

*Primary Examiner*—Weilun Lo
(74) *Attorney, Agent, or Firm*—John Van Ophem

(57) ABSTRACT

A belt-driven variable valve actuating mechanism includes a rocker having a central rocker axis that is substantially parallel with and spaced apart from a central axis of a rotary input shaft. A frame member has a first end configured for being pivotally mounted upon the input shaft and a second end pivotally carrying the rocker. A connecting rod has a first end configured for engaging an eccentric of the rotary input shaft and a second end pivotally attached to the rocker. The connecting rod transfers rotation of the input shaft to oscillation of the rocker relative to the rocker central axis. An output cam is configured for being pivotally mounted upon the input shaft. A belt engages the rocker and the output cam, and transfers oscillation of the rocker to oscillation of the output cam.

28 Claims, 4 Drawing Sheets

BELT-DRIVEN VARIABLE VALVE ACTUATING MECHANISM

CROSS-REFERENCE TO RELATED APPLICATIONS

This application claims the benefit of U.S. Provisional Patent Application Ser. No. 60/184,544, filed Feb. 24, 2000.

TECHNICAL FIELD

The present invention relates to variable valve mechanisms.

BACKGROUND OF THE INVENTION

Variable valve actuating mechanisms enable the variation of the timing, lift and duration (i.e., the valve lift profile) of associated valves, such as, for example, the valves of an internal combustion engine. Two examples of variable valve actuating mechanisms are detailed in commonly-assigned U.S. Pat. Nos. 5,937,809 and 6,019,076, the disclosure of which are incorporated herein by reference.

As related to internal combustion engines, conventional variable valve mechanisms are associated with a cam or input shaft of the engine. More particularly, a conventional variable valve mechanism typically includes a roller which engages an input cam of the input shaft or the engine camshaft. One or more link or rocker arms carry and link the roller to an output cam. Rotation of the input cam displaces the roller to create oscillatory movement of the components coupled thereto, such as link or rocker arms, relative to the central axis of the input shaft or camshaft. The oscillatory movement of the components that are coupled to the roller, in turn, directly or indirectly oscillate an output cam and thereby actuate one or more valves of the engine.

A biasing means, such as one or more return springs, is generally required in order to maintain the roller in contact with the input cam thereby reducing any mechanical lash. The use of return springs, however, negatively impacts the durability and limits the operating range of conventional variable valve mechanisms, thereby limiting the range of engine operation speeds over which the variable valve mechanism can be efficiently utilized. In addition to return springs, conventional variable valve mechanisms typically include numerous other component parts, such as link arms, joints, pins and frames, and are thus relatively complex mechanically. The numerous component parts increase the cost of the mechanism and make the mechanism more difficult to assemble and to manufacture.

Many of these numerous component parts are directly or indirectly coupled to the roller, and are therefore caused to pivot relative to the central axis of the input shaft as the input cam displaces the roller. Each of these components parts increase the mass of the structure which undergoes pivotal movement, and thereby further limits the range of engine operation speeds over which the variable valve mechanism can be used. The joints and pins that interconnect the component parts of a conventional variable valve mechanism are subject to interfacial frictional forces that negatively impact durability and efficiency of the mechanism.

As stated above, conventional VVA mechanisms generally include one or more link or rocker arms that carry and/or connect the roller of the mechanism with the output cam of the mechanism. The use of links and/or rockers increase the size of the VVA mechanism, and thus a larger space is required in order to install the VVA mechanism within the engine. The links and rocker arms are typically coupled together by joints and/or pins, which further increase the number of component parts and make the VVA mechanism relatively complex from a mechanical standpoint. Furthermore, the joints and pins are subject to interfacial frictional forces that negatively impact durability and efficiency. Moreover, the link adds to the oscillatory mass of the VVA mechanism, and thereby limits the effective engine operating range within which the VVA mechanism can be used.

Therefore, what is needed in the art is a variable valve mechanism having fewer component parts.

Furthermore, what is needed in the art is a variable valve mechanism with fewer joints and/or pins, and thus has reduced frictional losses.

Still further, what is needed in the art is a variable valve mechanism that eliminates the use of return springs, and is therefore operable over an increased range of engine operating speeds.

Moreover, what is needed in the art is a variable valve mechanism that has reduced pivoting mass, and is therefore operable over an increased range of engine operating speeds.

SUMMARY OF THE INVENTION

The present invention provides a belt-driven variable valve actuating mechanism.

The invention comprises, in one form thereof, a rocker having a central rocker axis that is substantially parallel with and spaced apart from a central axis of a rotary input shaft. A frame member has a first end configured for being pivotally mounted upon the input shaft and a second end pivotally carrying the rocker. A connecting rod has a first end configured for engaging an eccentric of the rotary input shaft and a second end pivotally attached to the rocker. The connecting rod transfers rotation of the input shaft to oscillation of the rocker relative to the rocker central axis. An output cam is configured for being pivotally mounted upon the input shaft. A belt engages the rocker and the output cam, and transfers oscillation of the rocker to oscillation of the output cam.

An advantage of the present invention is that it uses fewer component parts relative to a conventional variable valve mechanism, thereby reducing the cost and complexity of the mechanism.

Another advantage of the present invention is that fewer joints/pins are necessary relative to a conventional variable valve mechanism, thereby reducing frictional losses and increasing durability of the mechanism.

A still further advantage of the present invention is that return springs are not required, thereby further increasing the durability of the mechanism and enabling use of the mechanism over a wider range of engine operating conditions.

An even further advantage of the present invention is that the pivoting mass is substantially reduced, thereby rendering the mechanism operable over a wider range of engine operating speeds.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
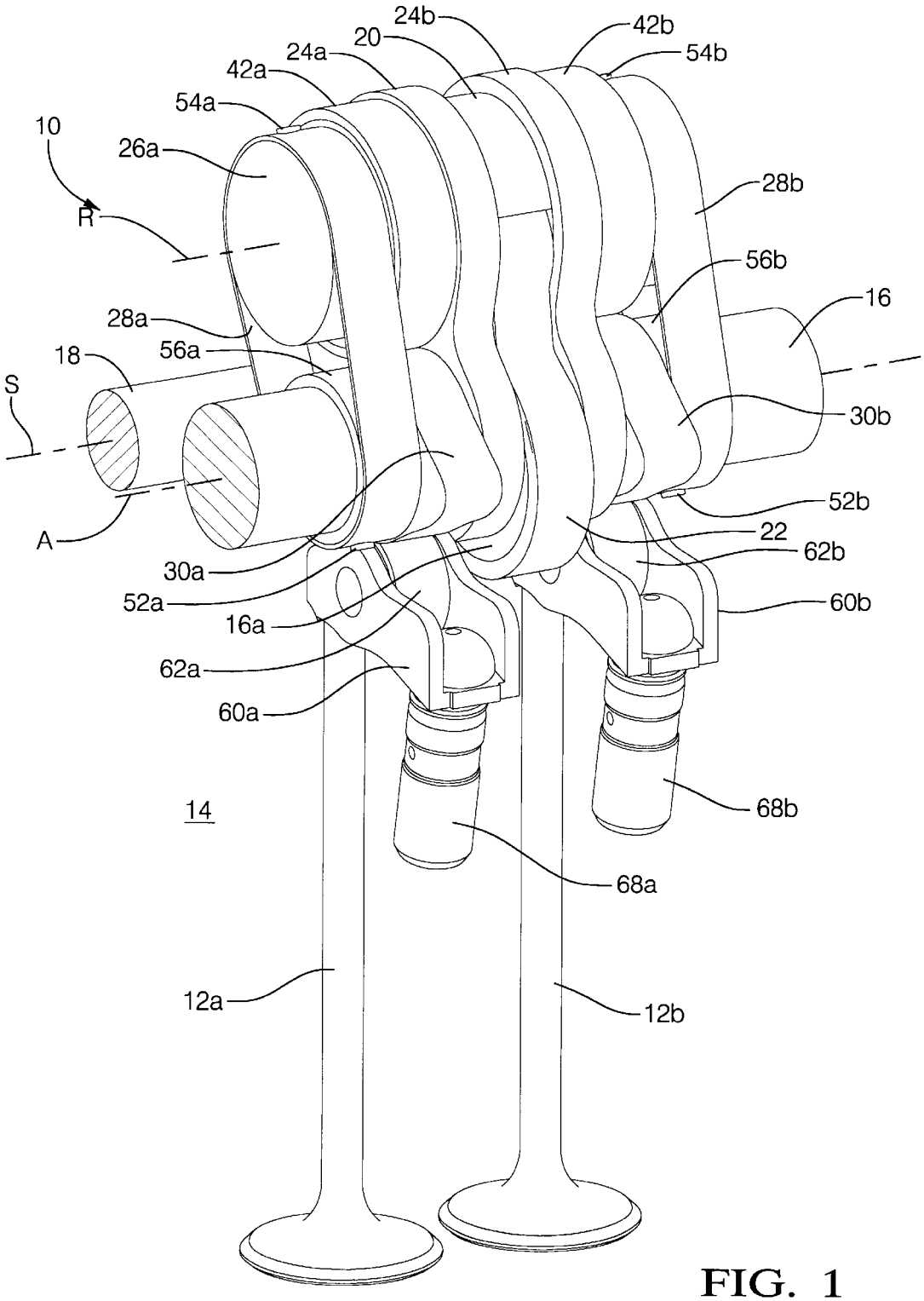
FIG. 1 is a perspective view of one embodiment of the belt-driven variable valve mechanism of the present invention.

Referring now to the drawings, and particularly to FIG. 1, there is shown one embodiment of a belt driven variable valve actuating (VVA) mechanism of the present invention. Generally, and as will be more particularly described hereinafter, VVA mechanism 10 is operably associated with valves 12*a*, 12*b* and with rotary input shaft 16 of internal combustion engine 14. Control shaft 18 is pivoted to selectively vary the timing, duration and lift, i.e., the valve lift profile, of valves 12*a*, 12*b*. VVA 10 includes rocker 20, connecting rod 22, frame members 24*a*, 24*b*, drum sleeves 26*a*, 26*b* (only one shown), belts 28*a*, 28*b* and output cams 30*a*, 30*b*.

Rotary input shaft 16 is an elongate shaft member, such as, for example, a camshaft of engine 14. Input shaft 16 has central axis A, and is rotated three-hundred and sixty degrees (360 degrees) about central axis A. Input shaft 16 is driven to rotate in timed relation to the engine crankshaft (not shown), such as, for example, by a camshaft drive, chain, or other suitable means. Input shaft 16 extends the length of the cylinder head (not shown) of multi-cylinder engine 14. A single VVA mechanism 10 is associated with each cylinder of engine 14. Input shaft 16 includes input eccentric 16*a* which rotates as substantially one body with input shaft 16. Input eccentric 16*a* is, for example, affixed to or integral with input shaft 16.

Figure 2:
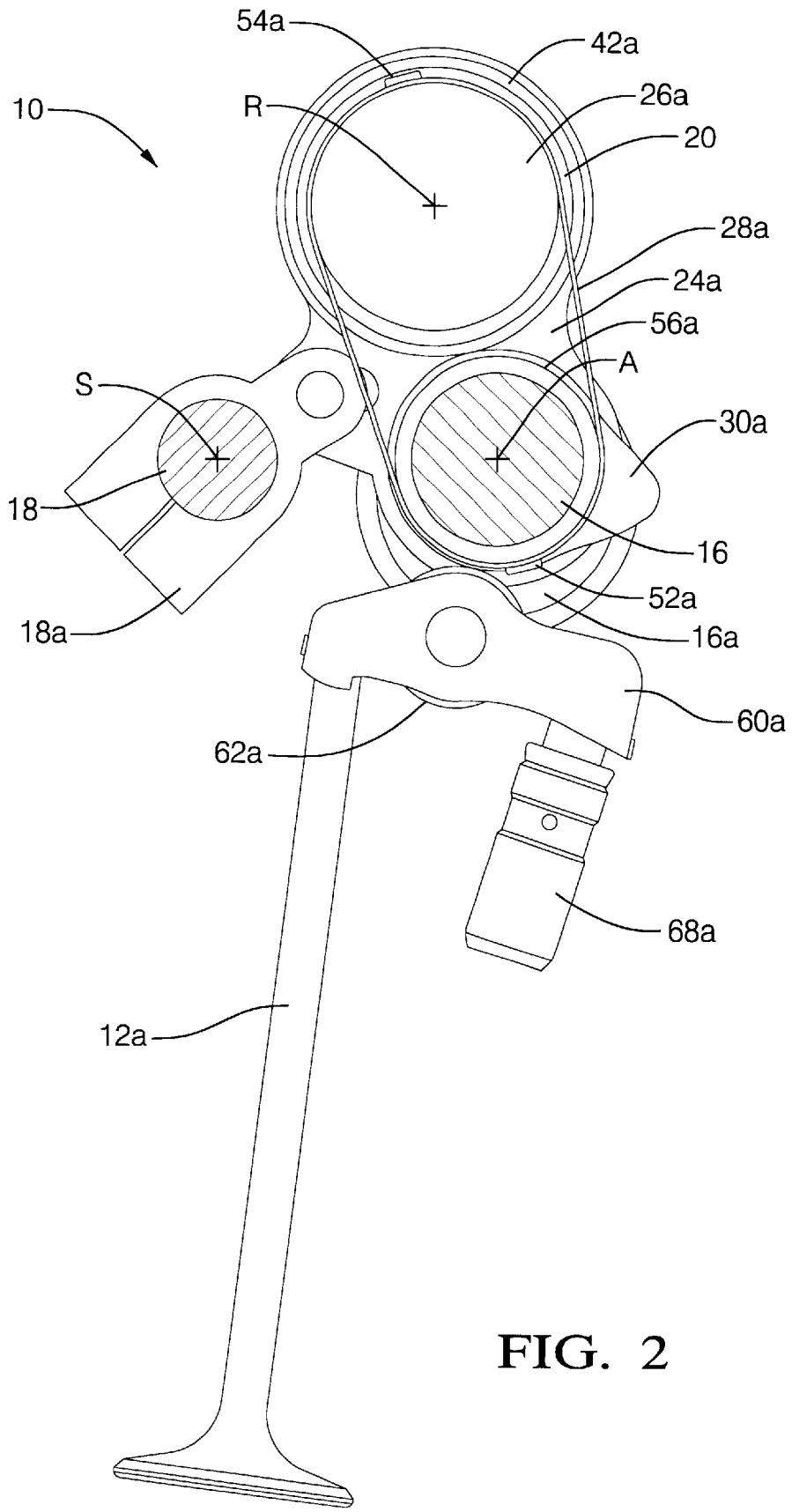
FIG. 2 is an end view of the belt-driven variable valve mechanism of FIG. 1.

Control shaft 18 is selectively pivoted, such as, for example, by an actuator subassembly (not shown) to establish the lift profile of valves 12*a*, 12*b*, as will be more particularly described hereinafter. Control shaft 18 pivots relative to shaft axis S, which is substantially parallel with and spaced apart from central axis A of input shaft 16. Control shaft 18 is coupled to each of frame members 24*a*, 24*b* by respective shaft couplers 18*a*, 18*b* (FIG. 2, only one shown), such as, for example, shaft clamps, such that pivotal movement of control shaft 18 relative to shaft axis S is transferred to pivoting of frame members 24*a*, 24*b* relative to central axis A.

Figure 4:
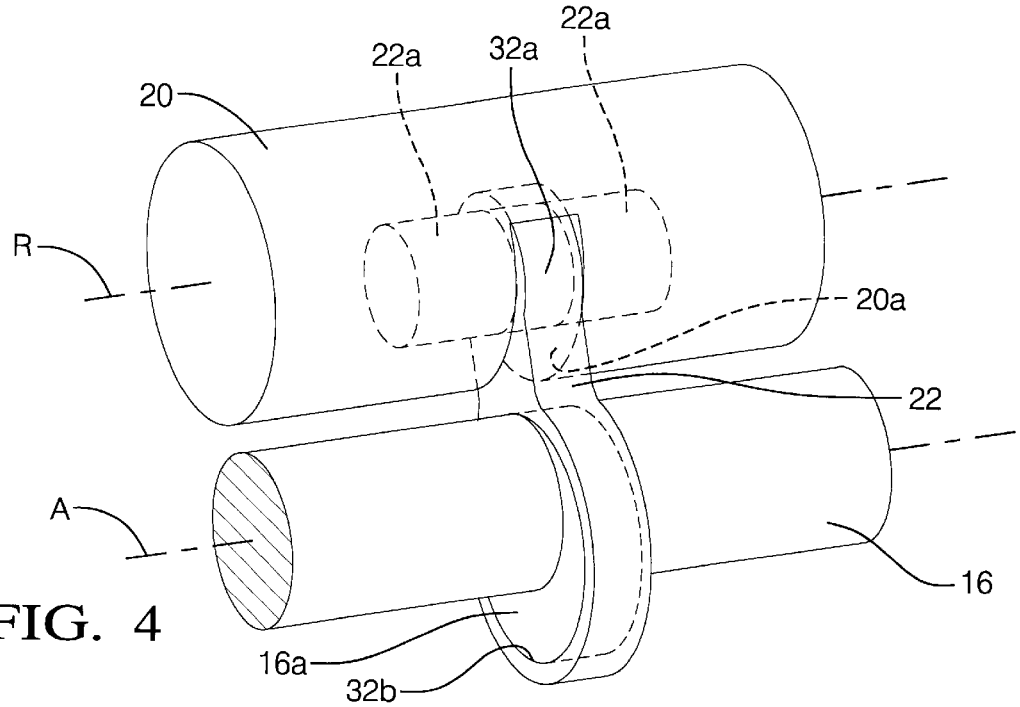
FIG. 4 is a detail view of the connecting rod and rocker of FIG. 1.

Rocker 20 is an elongate arm member having central axis R. Central axis R is substantially parallel with and spaced apart from central axis A of input shaft 16. As best shown in FIG. 4, rocker 20 defines notched or recessed section 20*a*. A first end (not referenced) of connecting rod 22 is pivotally coupled by rod coupler 22*a*, such as, for example, a pin or peg, to rocker 20 at notch section 20*a*. Rocker 20 is pivotally carried by each of frame members 24*a*, 24*b*, such that pivotal movement of frame members 24*a*, 24*b* relative to central axis A results in the pivoting of rocker 20 relative to central axis A. Rocker 20 is free to pivot within and relative to each of frame members 24*a*, 24*b* and about its own central axis R. Drum sleeves 26*a*, 26*b* are affixed to rocker 20 at opposite ends thereof.

Connecting rod 22 is an elongate arm member that is pivotally coupled at a first end to rocker 20 and at the opposite end to eccentric 16*a* of input shaft 16. More particularly, first end (not referenced) of connecting rod 22 defines orifice 32*a* (see FIG. 4) therethrough, within which is received at least a portion of rod coupler 22*a* to thereby pivotally couple connecting rod 22 to rocker 20. A second end (not referenced) of connecting rod 22 defines orifice 32*b* therethrough, within which is disposed at least a portion of eccentric 16*a* to thereby couple connecting rod 22 to input shaft 16. Connecting rod 22 transfers rotation of input shaft 16 and eccentric 16*a* to oscillatory movement of rocker 20 within frame members 24*a*, 24*b* and about rocker axis R. Input eccentric 16*a* is configured to impart a fixed range or degree of oscillation, such as, for example, forty-five (45) degrees, to rocker 20.

Figure 3:
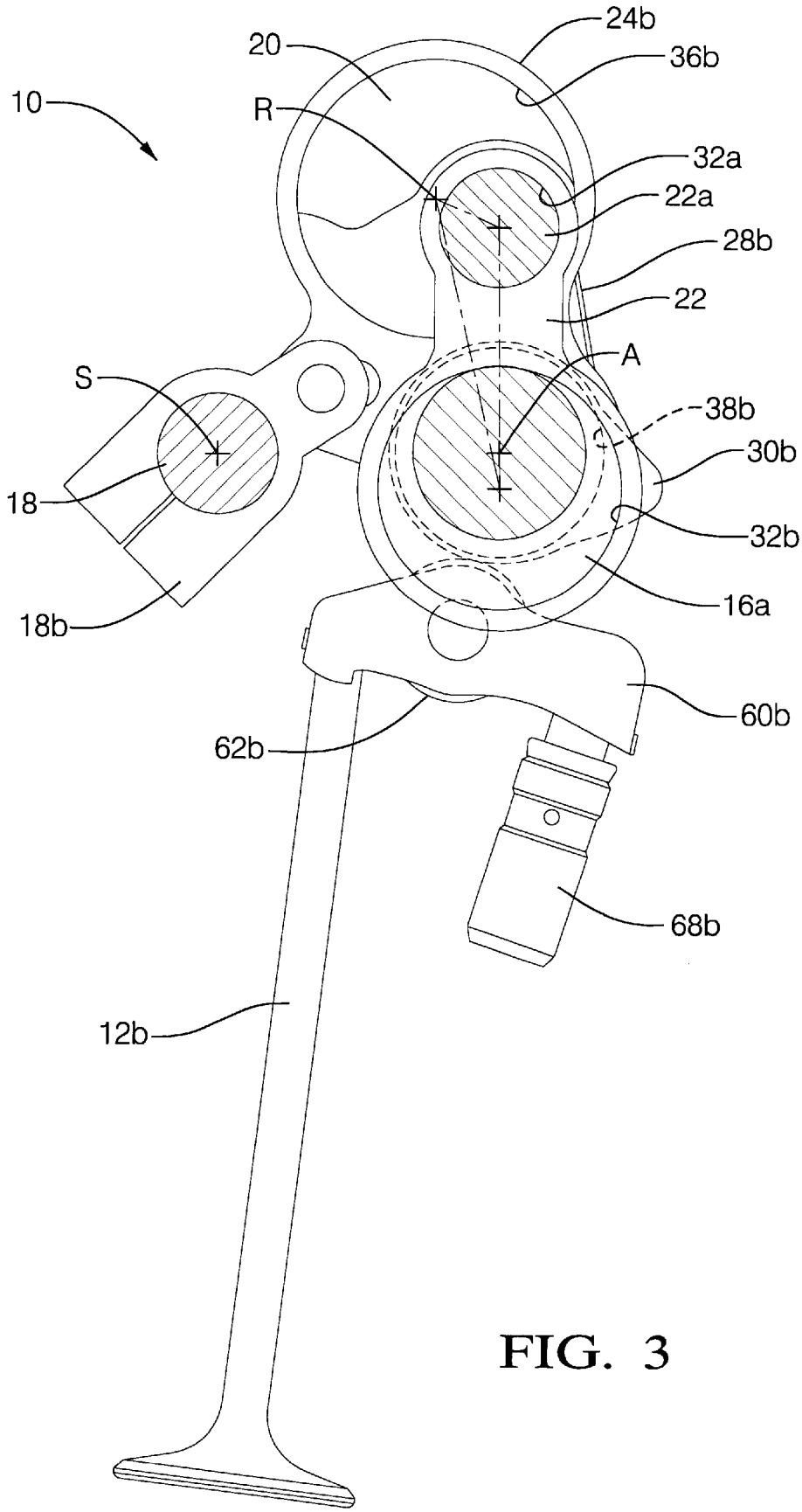
FIG. 3 is a cut-away end view of the belt-driven variable valve mechanism of FIG. 1, wherein certain components are omitted for the sake of clarity.

Frame members 24*a*, 24*b* are substantially identical. As best shown in FIG. 3, wherein only frame member 24*b* is shown for the sake of clarity, each of frame members 24*a*, 24*b* define a respective frame rocker orifice 36*a*, 36*b* and a respective frame shaft orifice 38*a*, 38*b*. Each frame rocker orifice 36*a*, 36*b* receives a corresponding portion of rocker 20 to thereby pivotally associate frame members 24*a*, 24*b* and rocker 20 such that rocker 20 is free to undergo oscillatory movement relative to frame members 24*a*, 24*b* and about rocker axis R, and be carried by frame members 24*a*, 24*b* during pivotal movement thereof relative to central axis A of input shaft 16. Each frame shaft orifice 38*a*, 38*b* receives a corresponding portion of input shaft 16 to thereby pivotally associate frame members 24*a*, 24*b* and input shaft 16 such that frame members 24*a*, 24*b* are free to pivot relative to central axis A and yet are not rotated by the rotation of input shaft 16. Each of frame members 24*a*, 24*b* further include a respective bearing support portion 42*a*, 42*b* (see FIG. 1). Bearing support portions 42*a*, 42*b* surround a respective one of frame rocker orifices 36*a*, 36*b*, and are substantially cylindrical in shape. Bearing support portions 42*a*, 42*b* are affixed, such as, for example, welded, to or formed integrally with frame members 24*a*, 24*b*. Frame member 24*a* is disposed on a first side (not referenced) of connecting rod 22 while frame member 24*b* is disposed on the opposite side of connecting rod 22.

Drum sleeves 26*a*, 26*b* are affixed to respective ends of rocker 20. More particularly, drum sleeve 26*a* is disposed upon rocker 20 generally adjacent bearing support 42*a*, and drum sleeve 26*b* is disposed upon rocker 20 generally adjacent bearing support 42*b*. Each of drum sleeves 26*a*, 26*b* are affixed, such as, for example welded, bolted or otherwise secured by suitable means, to rocker 20. The outer surfaces (not referenced) of drum sleeves 26*a*, 26*b* are configured for engaging an inside surface (not referenced) of a respective belt 28*a*, 28*b*.

Belts 28*a*, 28*b* are disposed around and engage a portion of the outside surface (not referenced) of drum sleeves 26*a*, 26*b*, respectively. Belts 28*a*, 28*b* also engage respective surfaces of output cams 30*a*, 30*b*, respectively, as will be more particularly described hereinafter. Belts 28*a*, 28*b* are each fastened to output cams 30*a*, 30*b* by belt fasteners 52*a*, 52*b*, respectively, such as, for example, clamps, bolts, pins, screws, rivets, roll pins or other suitable fasteners. Similarly, belts 28*a*, 28*b* are each fastened to drum sleeves 26*a*, 26*b*, respectively, by fasteners 54*a*, 54*b*, such as, for example, clamps, bolts, pins, screws, rivets, roll pins or other suitable fasteners. Belts 28*a*, 28*b* are constructed of, for example, metal, reinforced rubber, or other suitable material.

Output cams 30*a*, 30*b* are pivotally mounted upon input shaft 16, generally adjacent a respective frame member 24*a*, 24*b*. Output cams 30*a*, 30*b* are not rotated by rotation of input shaft 16, but are rather free to pivot relative to central axis A thereof. Output cams 30*a*, 30*b* each include belt engaging surfaces 56*a*, 56*b*, such as, for example, substantially cylindrical surfaces. Belt engaging surfaces 56*a*, 56*b* are affixed to or integral with a respective output cam 30*a*, 30*b*. Each of output cams 30*a*, 30*b* are associated with a respective roller finger follower (RFF) 60*a*, 60*b*. More particularly, the outer surface (not referenced) or of output cams 30*a*, 30*b* engage rollers 62*a*, 62*b*, respectively, of a corresponding RFF 60*a*, 60*b*. As will be understood by one skilled in the art, the outer surfaces of output cams 30*a*, 30*b* define a lift profile which includes a base circle portion and a lift portion (neither of which is referenced).

In use, valves 12*a*, 12*b* are actuated by VVA mechanism 10 in accordance with the lift profile of the portion of the outer surfaces of output cams 30*a*, 30*b* that engage rollers 62*a*, 62*b*, respectively, as output cams 30*a*, 30*b* oscillate through the predetermined range of oscillation. The oscillation of output cams 30*a*, 30*b*, and the portion of the outer surfaces thereof that engage rollers 62*a*, 62*b*, respectively, cause RFFs 60*a*, 60*b* to pivot about lash adjusters 68*a*, 68*b*, respectively, and actuate a corresponding one of valves 12*a*, 12*b*.

More particularly, and as stated above, input shaft 16 is driven to rotate relative to central axis A thereof in timed relation to the crankshaft (not shown) of engine 14. Connecting rod 22 transfers rotation of input shaft 16 and eccentric 16*a* to oscillatory movement of rocker 20 within frame members 24*a*, 24*b* and relative to central axis R. Input eccentric 16*a* is configured to impart to rocker 20 a fixed range or degree of oscillation, such as, for example, forty-five (45) degrees. Drum sleeves 26*a*, 26*b* are affixed to rocker 20, and thus drum sleeves 26*a*, 26*b* oscillate as substantially one body with rocker 20. Belts 28*a*, 28*b* are secured to drum sleeves 26*a*, 26*b*, respectively, by belt fasteners 54*a*, 54*b*, respectively, and to output cams 30*a*, 30*b*, respectively, by belt fasteners 52*a*, 52*b*, respectively, and transfer the oscillation of drum sleeves 26*a*, 26*b* to corresponding oscillatory movement of output cams 30*a*, 30*b*.

The valve lift profile of valves 12*a*, 12*b* is selected, and varied, dependent at least in part upon the angular position of control shaft 18. As stated above, control shaft 18 is coupled by shaft couplers 18*a*, 18*b* to frame members 24*a*, 24*b*, respectively. Thus, as control shaft 18 is pivoted relative to central axis S thereof frame members 24*a*, 24*b* are, in turn, pivoted relative to central axis A of input shaft 16. Frame members 24*a*, 24*b* carry rocker 20, and thus the pivoting of frame members 24*a*, 24*b* relative to central axis A, in turn, pivots center axis R of rocker 20 relative to central axis A of input shaft 16. Drum sleeves 26*a*, 26*b* are affixed to rocker 20, and thus pivoting of center axis R of rocker 20 relative to central axis A of input shaft 16 is transferred to pivotal movement of drum sleeves 26*a*, 26*b* relative to central axis A. The pivoting of drum sleeves 26*a*, 26*b* relative to central axis A is transferred to pivoting of output cams 30*a*, 30*b* relative to central axis A by belts 28*a*, 28*b*, respectively. Thus, the angular position of control shaft 18 relative to central axis S thereof determines the angular relation of output cams 30*a*, 30*b* relative to central axis A and relative to rollers 62*a*, 62*b* of RFFs 60*a*, 60*b*, respectively, thereby determining the portion of the lift profile of output cams 30*a*, 30*b* which engage rollers 62*a*, 62*b* during the fixed angular range of oscillation of output cams 30*a*, 30*b*. The portion of the lift profile of output cams 30*a*, 30*b* which engage rollers 62*a*, 62*b*, in turn, determines the valve lift profile of valves 12*a*, 12*b*.

For example, a relatively high amount of valve lift is obtained by placing the lift portion of the lift profile of output cams 30*a*, 30*b* well within the fixed angular range of oscillation thereof. Thus, as output cams 30*a*, 30*b* are oscillated, at least a substantial portion of the lift portion of the lift profile thereof engages rollers 62*a*, 62*b*, respectively, and impart a correspondingly high amount of lift to valves 12*a*, 12*b*. Conversely, and as a second example, a relatively low amount of or substantially no valve lift is obtained by placing the lift portion of the valve lift profile of output cams 30*a*, 30*b* only partially within or substantially entirely outside the fixed angular range of oscillation thereof. Thus, as output cams 30*a*, 30*b* are oscillated, only a small portion of the lift portion or only the base circle portion of the lift profile thereof engages rollers 62*a*, 62*b*, respectively, and impart a correspondingly small amount of lift to valves 12*a*, 12*b*.

As stated above, connecting rod 22 is coupled by rod coupler 22*a* to rocker 20. As control shaft 18 is pivoted relative to central axis S thereof, thereby causing frame members 24*a*, 24*b* and central axis R of rocker 20 to pivot relative to central axis A, rocker 20 itself pivots relative to its own center axis R within frame members 24*a*, 24*b*. With input shaft 16 rotating, for example, in a clockwise direction, the pivoting of rocker 20 relative to its center axis R advances the timing of the actuation of valves 12*a*, 12*b* with VVA mechanism 10 in a low-lift position relative to the timing of the actuation of valves 12*a*, 12*b* with VVA mechanism 10 in a high-lift position.

Figure 5:
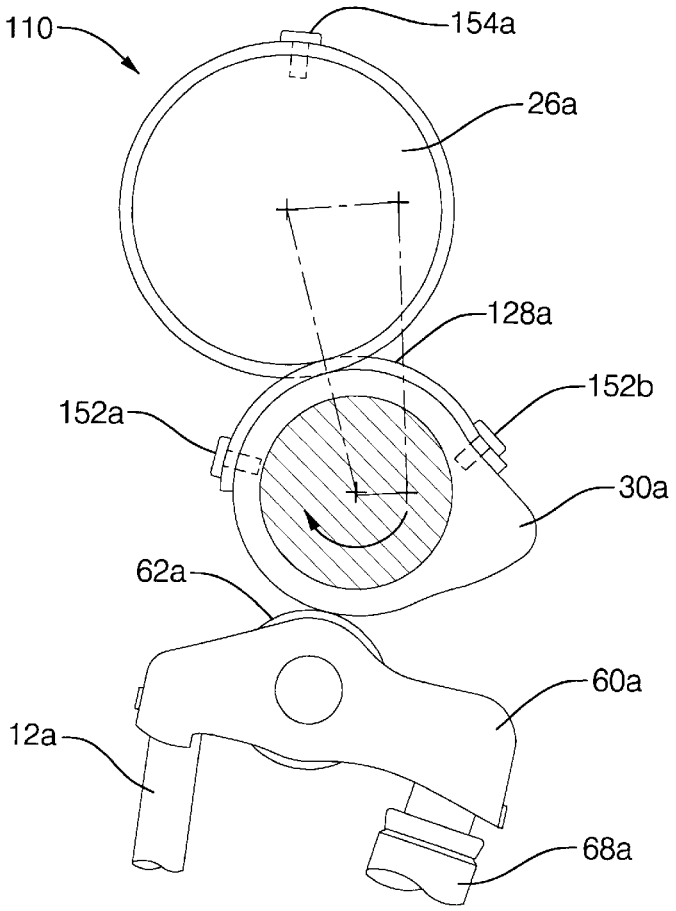
FIG. 5 is an end view of a second embodiment of a belt-driven variable valve mechanism of the present invention.
Figure 6:
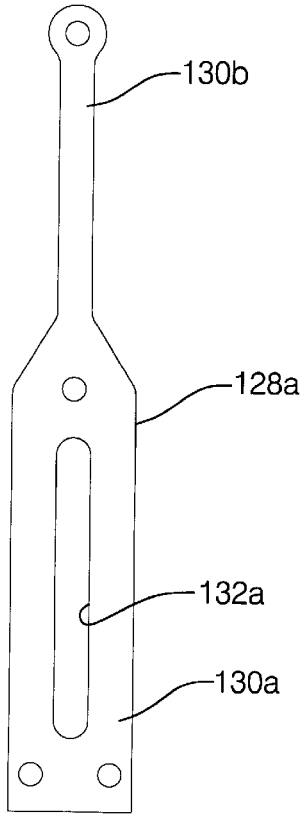
FIG. 6 is a top view of the belt of FIG. 5.

In the embodiment shown, belts 28*a*, 28*b* are configured as cylindrical and/or continuous belts. However, it is to be understood that belt-driven VVA mechanism 10 can be alternately configured, such as, for example, with non-continuous and/or non-cylindrical belts. A second embodiment of a belt-driven VVA mechanism of the present invention is shown in FIGS. 5 and 6, in which the same reference characters used in referring to component parts of belt-driven VVA mechanism 10 have been used to indicate corresponding parts. Belt-drive VVA mechanism 110 includes a cross-over belt 128*a* which transfers oscillatory movement of rocker 20 (not shown) and drum sleeve 26*a* to oscillation of output cam 30*a*. As best shown in FIG. 6, belt 128*a* includes a first portion 130*a* and a second portion 130*b*. First portion 130*a* defines a longitudinal slot 132*a* therethrough. Belt fasteners 152*a*, 152*b* and 154*a*, such as, for example, pins or rivets, affix belt 128*a* to output cam 32*a* and drum sleeve 26*a*, respectively. More particularly, belt 128*a* is affixed at one end to the base circle portion of the lift profile of output cam 30*a* by fastener 152*a*. Belt 128*a* the wraps around drum sleeve 26*a* and is fastened thereto by fastener 154*a*, passes through slot 132 and is fastened at the other end by fastener 152*b* to output cam 30*a*.

In the embodiments shown, output cams 30*a*, 30*b* each include belt-engaging surfaces 56*a*, 56*b*. Similarly, the outer surfaces (not referenced) of drum sleeves 26*a*, 26*b* are configured for engaging an inside surface (not referenced) of a respective belt 28*a*, 28*b*, and are thus also belt-engaging surfaces. Each pair of belt-engaging surfaces, i.e., surfaces 56*a*, 56*b* and the belt-engaging surfaces of drum sleeves 26*a*, 26*b*, are configured as, for example, substantially cylindrical surfaces. However, it is to be understood that one or both pairs of belt-engaging surfaces 56*a*, 56*b* and of drum sleeves 26*a*, 26*b* can be alternately configured, such as, for example, with an elliptical, eccentric or various other shape. It should be particularly noted that, by varying the shapes of at least one pair of the belt-engaging surfaces, such as, for example, belt-engaging surfaces 56*a*, 56*b*, certain benefits can be obtained. For example, to obtain a more desirable low-lift valve lift profile at least one pair of the belt-engaging surfaces is configured with an elliptical shape to thereby decrease the duration of the lift and obtain low ratio of valve lift to lift duration. The valve lift profile therefore has a sharper peak and is less flat. Thus, VVA mechanism 10 is configurable to meet various application-specific requirements by providing a family of valve lift profiles.

It should be further particularly noted that the diameter of the belt-engaging surfaces 56*a*, 56*b* and of drum sleeves 26*a*, 26*b* are similarly modified from the embodiments shown to obtain certain benefits. For example, by configuring the belt-engaging surfaces of the drum sleeves to have a relatively large diameter relative to the belt-engaging surfaces of the output cams, a relatively small or slight degree of oscillation of rocker 20 and, thus, of the relatively large-diameter belt-engaging surfaces of the drum sleeves results in an relatively large or magnified degree of oscillation of the small-diameter belt-engaging surfaces of the output cams. Thus, substantially less oscillation of rocker 20 is required in order to oscillate the output cams through a fixed angle or range of oscillation when the output cams are configured with relatively small diameter belt-engaging surfaces relative to the belt-engaging surfaces of the drum sleeves.

In the embodiments shown, VVA mechanism 10 is configured without means for lash adjustment. However, it is to be understood that VVA mechanism 10 can be alternately configured to include lash adjustment means, such as, for example, belt tensioning means to adjust tension and/or slack of the belts and thereby substantially remove and/or compensate for lash.

In the embodiments shown, VVA mechanism 10 includes two frame members 24*a*, 24*b* and two output cams 30*a*, 30*b*, to thereby actuate dual inlet valves 12*a*, 12*b* of a corresponding cylinder of engine 14. However, it is to be understood that VVA mechanism 10 can be alternately configured, such as, for example, for use with a cylinder having only one inlet valve. In this embodiment, the VVA mechanism includes a single frame member and a single output cam.

In the embodiments shown, a single VVA mechanism 10 is associated with one cylinder (not shown) of engine 14. However, it is to be understood that multiple VVA mechanisms of the present invention can be associated with each cylinder of an engine, and be operable to variably actuate the intake and/or exhausts valves thereof.

In the embodiment shown, frame members 24*a*, 24*b* are pivotally mounted upon input shaft 16. However, it is to be understood that VVA mechanism 10 can be alternately configured, such as, for example, having frame members mounted to a secondary shaft or other structure and still being configured for pivotal movement relative to the central axis of the input shaft or relative to a central axis of the secondary shaft.

In the embodiment shown, VVA mechanism 10 is configured for use with an internal combustion engine. However, it is to be understood that VVA mechanism 10 can be alternately configured, such as, for example, for use with various other mechanisms or machinery which require may advantageously utilize variable displacement, duration and/or timing of one or more moving components.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A belt-driven variable valve mechanism, comprising:

a rocker having a central rocker axis, said rocker central axis being substantially parallel with and spaced apart from a central axis of a rotary input shaft;

at least one frame member having a first end and a second end, said first end configured for being pivotally mounted upon the input shaft, said second end pivotally carrying said rocker;

a connecting rod having a first end and a second end, said first end configured for engaging an eccentric of the rotary input shaft, said second end pivotally attached to said rocker, said connecting rod configured for transferring rotation of the input shaft to oscillation of said rocker relative to said rocker central axis;

at least one output cam configured for being pivotally mounted upon the input shaft; and at least one belt, each of said at least one belt engaging said rocker and a corresponding one of said at least one output cam, said at least one belt configured for transferring oscillation of said rocker to oscillation of a corresponding one of said at least one output cam.

2. The belt-driven variable valve mechanism of claim 1, further comprising a control shaft pivotable about a central shaft axis, said central shaft axis being substantially parallel with and spaced apart from the central axis of the input shaft, said control shaft being pivotally coupled to each of said at least one frame member.

3. The belt-driven variable valve mechanism of claim 1, wherein said at least one belt is fastened to at least one of said rocker and a corresponding one of said at least one output cam.

4. The belt-driven variable valve mechanism of claim 1, wherein each said at least one output cam includes a respective belt-engaging surface, said belt-engaging surface being one of attached to and integral with said at least one output cam, each of said at least one belt engaging at least a portion of said belt-engaging surface of a corresponding said at least one output cam.

5. The belt-driven variable valve mechanism of claim 1, wherein said rocker includes at least one belt-engaging surface, said at least one belt-engaging surface being one of attached to and integral with said rocker, each of said at least one belt-engaging surface of said rocker corresponding to one of said at least one output cam, each of said at least one belt engaging at least a portion of a corresponding one of said at least one belt-engaging surface of said rocker.

6. The belt-driven variable valve mechanism of claim 1, wherein each of said at least one output cam includes a respective belt-engaging surface, said rocker includes at least one belt-engaging surface, each of said at least one belt-engaging surface of said rocker corresponding to one of said at least one output cam, each said at least one belt engaging at least a portion of said belt-engaging surface of a corresponding one of said at least one output cam and a corresponding one of said at least one belt-engaging surface of said rocker.

7. The belt-driven variable valve mechanism of claim 6, wherein each of said at least one belt is fastened to at least one of said belt-engaging surface of a corresponding one of said at least one output cam and a corresponding one of said at least one belt-engaging surface of said rocker.

8. The belt-driven variable valve mechanism of claim 6, wherein said at least one belt-engaging surface of said rocker comprises a drum sleeve affixed to said rocker.

9. The belt-driven variable valve mechanism of claim 6, wherein said at least one belt-engaging surface of said rocker and said belt-engaging surface of each of said at least one output cam are substantially cylindrical, said belt-engaging surface of each of said at least one output cam having a first diameter, said at least one belt-engaging surface of said rocker having a second diameter.

10. The belt-driven variable valve mechanism of claim 9, wherein said first diameter is less than said second diameter.

11. The belt-driven variable valve mechanism of claim 6, wherein said belt-engaging surface of each of said at least one output cam is one of elliptical and eccentric in shape.

12. The belt-driven variable valve mechanism of claim 6, wherein each of said at least one belt-engaging surface of said rocker is one of elliptical and eccentric in shape.

13. The belt-driven variable valve mechanism of claim 1, wherein each of said at least one frame member includes a bearing support, said bearing support being one of attached to and integral with said frame member.

14. A belt-driven variable valve mechanism, comprising:

an elongate input shaft having a central axis, an input eccentric disposed on said input shaft;

a rocker having a central rocker axis, said central rocker axis being substantially parallel with and spaced apart from said central axis of said rotary input shaft;

at least one frame member having a first end and a second end, said first end pivotally mounted upon said input shaft, said second end pivotally carrying said rocker;

a connecting rod having a first end and a second end, said first end engaging said eccentric, said second end pivotally attached to said rocker, said connecting rod configured for transferring rotation of said eccentric to oscillation of said rocker relative to said rocker central axis;

at least one output cam pivotally mounted upon said input shaft; and at least one belt, each of said at least one belt engaging said rocker and a corresponding one of said at least one output cam, said at least one belt configured for transferring oscillation of said rocker to oscillation of a corresponding one of said at least one output cam.

15. The belt-driven variable valve mechanism of claim 14, further comprising a control shaft pivotable about a central shaft axis, said central shaft axis being substantially parallel with and spaced apart from said central axis of said input shaft, said control shaft being pivotally coupled to each of said at least one frame member.

16. The belt-driven variable valve mechanism of claim 14, wherein said at least one belt is fastened to at least one of said rocker and said at least one output cam.

17. The belt-driven variable valve mechanism of claim 14, wherein each said at least one output cam includes a respective belt-engaging surface, said belt-engaging surface being one of attached to and integral with said at least one output cam, each of said at least one belt engaging at least a portion of said belt-engaging surface of a corresponding said at least one output cam.

18. The belt-driven variable valve mechanism of claim 14, wherein said rocker includes at least one belt-engaging surface, said at least one belt-engaging surface being one of attached to and integral with said rocker, each of said at least one belt-engaging surface of said rocker corresponding to one of said at least one output cam, each of said at least one belt engaging at least a portion of a corresponding one of said at least one belt-engaging surface of said rocker.

19. The belt-driven variable valve mechanism of claim 14, wherein each of said at least one output cam includes a respective belt-engaging surface, said rocker includes at least one belt-engaging surface, each of said at least one belt-engaging surface of said rocker corresponding to one of said at least one output cam, each said at least one belt engaging at least a portion of said belt-engaging surface of a corresponding one of said at least one output cam and a corresponding one of said at least one belt-engaging surface of said rocker

20. The belt-driven variable valve mechanism of claim 19, wherein each of said at least one belt is fastened to at least one of said belt-engaging surface of a corresponding one of said at least one output cam and a corresponding one of said at least one belt-engaging surface of said rocker.

21. The belt-driven variable valve mechanism of claim 19, wherein said at least one belt-engaging surface of said rocker comprises a drum sleeve affixed to said rocker.

22. The belt-driven variable valve mechanism of claim 19, wherein said at least one belt-engaging surface of said rocker and said belt-engaging surface of each of said at least one output cam are substantially cylindrical, said belt-engaging surface of each of said at least one output cam having a first diameter, said at least one belt-engaging surface of said rocker having a second diameter.

23. The belt-driven variable valve mechanism of claim 22, wherein said first diameter is less than said second diameter.

24. The belt-driven variable valve mechanism of claim 19, wherein said belt-engaging surface of each of said at least one output cam is one of elliptical and eccentric in shape.

25. The belt-driven variable valve mechanism of claim 19, wherein each of said at least one belt-engaging surface of said rocker is one of elliptical and eccentric in shape.

26. The belt-driven variable valve mechanism of claim 14, wherein each of said at least one frame member includes a bearing support, said bearing support being one of attached to and integral with said frame member.

27. The belt-driven variable valve mechanism of claim 14, wherein said at least one belt defines a longitudinal slot therein, each of said at least one belt engaging said rocker and a corresponding one of said at least one output cam such that a portion of said belt is disposed within said longitudinal slot.

28. An internal combustion engine, comprising:

a belt-driven variable valve mechanism, including:

an elongate input shaft having a central axis, an input eccentric disposed on said input shaft;

a rocker having a central rocker axis, said central rocker axis being substantially parallel with and spaced apart from said central axis of said rotary input shaft;

at least one frame member having a first end and a second end, said first end pivotally mounted upon said input shaft, said second end pivotally carrying said rocker;

a connecting rod having a first end and a second end, said first end engaging said eccentric, said second end pivotally attached to said rocker, said connecting rod configured for transferring rotation of said eccentric to oscillation of said rocker relative to said rocker central axis;

at least one output cam pivotally mounted upon said input shaft; and at least one belt, each of said at least one belt engaging said rocker and a corresponding one of said at least one output cam, said at least one belt configured for transferring oscillation of said rocker to oscillation of a corresponding one of said at least one output cam.

* * * * *